US012546129B2

(12) United States Patent
McDaniel et al.

(10) Patent No.: US 12,546,129 B2
(45) Date of Patent: Feb. 10, 2026

(54) CONNECTION SYSTEM FOR CONCRETE SECTIONS

(71) Applicant: ERICO International Corporation, Solon, OH (US)

(72) Inventors: Steven McDaniel, Burton, OH (US); Anirudha Vaidya, Solon, OH (US); Samuel Barker, Solon, OH (US)

(73) Assignee: ERICO International Corporation, Solon, OH (US)

( * ) Notice: Subject to any disclaimer, the term of this patent is extended or adjusted under 35 U.S.C. 154(b) by 170 days.

(21) Appl. No.: 18/582,967

(22) Filed: Feb. 21, 2024

(65) Prior Publication Data

US 2024/0279940 A1 Aug. 22, 2024

Related U.S. Application Data

(60) Provisional application No. 63/486,369, filed on Feb. 22, 2023.

(51) Int. Cl.
*E04G 21/12* (2006.01)

(52) U.S. Cl.
CPC ..... *E04G 21/12* (2013.01)

(58) Field of Classification Search
CPC . E04B 1/21; E04B 1/215; E04C 5/163; E04G 21/12
See application file for complete search history.

(56) References Cited

U.S. PATENT DOCUMENTS

| | | | | |
|---|---|---|---|---|
| 3,151,653 | A | 10/1964 | Zahodfakin | |
| 3,426,816 | A | 2/1969 | Mclntire et al. | |
| 3,640,328 | A | 2/1972 | Tummarello | |
| 4,027,711 | A | 6/1977 | Tummarello | |
| 4,283,899 | A | 8/1981 | Wakamiya | |
| 4,974,888 | A | 12/1990 | Childers | |
| 5,340,252 | A | 8/1994 | Weddendorf | |
| 5,653,078 | A | 8/1997 | Kies et al. | |
| 6,007,284 | A | 12/1999 | Taneichi | |
| 6,240,697 | B1 | 6/2001 | Thompson et al. | |
| 6,350,093 | B1 | 2/2002 | Petersen et al. | |
| 8,132,767 | B2 | 3/2012 | Oh et al. | |
| 8,434,725 | B2 | 5/2013 | Oh et al. | |
| 8,984,825 | B2 * | 3/2015 | Junes | E02D 5/72 52/297 |
| 8,998,155 | B2 | 4/2015 | Oh | |
| 9,181,691 | B2 | 11/2015 | Thompson | |
| 9,222,251 | B2 | 12/2015 | Espinosa | |
| 9,303,676 | B2 | 4/2016 | Oh | |
| 9,394,706 | B2 | 7/2016 | Lin | |

(Continued)

FOREIGN PATENT DOCUMENTS

| | | | |
|---|---|---|---|
| CN | 205917869 U | 2/2017 | |
| EP | 2559817 A2 * | 2/2013 | E04B 1/4157 |

(Continued)

*Primary Examiner* — Christine T Cajilig
(74) *Attorney, Agent, or Firm* — Quarles & Brady LLP

(57) ABSTRACT

A column shoe assembly can include a shoe body that defines an internal cavity with a rear wall. A lower rod opening can open into the internal cavity and defines a connection axis. An access opening can open into the internal cavity on an opposite side of the connection axis from the rear wall. A thickened rim can extend along a perimeter of the access opening.

20 Claims, 11 Drawing Sheets

(56) References Cited

U.S. PATENT DOCUMENTS

| | | | | |
|---|---|---|---|---|
| 9,695,861 | B2 | 7/2017 | Steffl | |
| 9,915,277 | B2 | 3/2018 | Oh | |
| 10,202,753 | B2 | 2/2019 | Espinosa | |
| 10,578,137 | B2 | 3/2020 | Oh | |
| 11,047,409 | B2 | 6/2021 | Oh | |
| 11,466,447 | B2 | 10/2022 | Espinosa | |
| 2002/0037205 | A1 | 3/2002 | Taneichi | |
| 2002/0189175 | A1 | 12/2002 | Lancelot et al. | |
| 2005/0055897 | A1 | 3/2005 | Commins | |
| 2005/0115179 | A1* | 6/2005 | Viljakainen | E04H 12/2261 52/292 |
| 2010/0170166 | A1 | 7/2010 | Viljakainen | |
| 2010/0290859 | A1 | 11/2010 | Noce et al. | |
| 2011/0041449 | A1 | 2/2011 | Espinosa | |
| 2011/0041450 | A1 | 2/2011 | Espinosa | |
| 2011/0192111 | A1 | 8/2011 | White et al. | |
| 2014/0026515 | A1 | 1/2014 | Espinosa | |
| 2015/0197931 | A1 | 7/2015 | Espinosa | |
| 2015/0308101 | A1 | 10/2015 | Espinosa | |
| 2015/0322665 | A1* | 11/2015 | Kinnunen | E04B 1/215 52/297 |
| 2017/0037627 | A1 | 2/2017 | Espinosa | |
| 2017/0101771 | A1 | 4/2017 | Espinosa | |
| 2018/0363291 | A1 | 12/2018 | Espinosa | |
| 2020/0392733 | A1 | 12/2020 | Espinosa | |
| 2020/0399891 | A1 | 12/2020 | Espinosa | |

FOREIGN PATENT DOCUMENTS

| | | | | |
|---|---|---|---|---|
| JP | H06-147214 | A | 5/1994 | |
| JP | 3046250 | B2 | 5/2000 | |
| JP | 2002-004433 | A | 1/2002 | |
| JP | 2003-326471 | A | 11/2003 | |
| JP | 4043913 | B2 | 2/2008 | |
| JP | 4654009 | B2 | 3/2011 | |
| JP | 4808854 | B2 | 11/2011 | |
| KR | 20-0354373 | Y1 | 6/2004 | |
| KR | 10-0693374 | B1 | 3/2007 | |
| WO | WO-2007074212 | A1 * | 7/2007 | E02D 5/52 |
| WO | WO-2012056100 | A1 * | 5/2012 | E02D 5/72 |
| WO | WO-2012056101 | A1 * | 5/2012 | E02D 5/72 |

* cited by examiner

CONNECTION SYSTEM FOR CONCRETE SECTIONS

CROSS-REFERENCE TO RELATED APPLICATIONS

This application claims priority to U.S. provisional patent application No. 63/486,369, filed Feb. 22, 2023, the entirety of which is incorporated herein by reference.

BACKGROUND

Concrete is a mixture of cement, water, and aggregates. Known for its strength, durability, low maintenance, energy efficiency, and relatively low cost, concrete is one of the most frequently used building materials used for constructing buildings, bridges, roads, sidewalks and other structures. In some structures, concrete is used in combination with reinforcement bars (herein, rebars). The combination of concrete and rebars is known as reinforced concrete and is widely used to mitigate the weak tension of concrete by distributing the tensile forces evenly across the structure and support heavy loads.

SUMMARY

Some examples of the disclosed technology provide a column shoe assembly. A shoe body can include an access opening and a lower rod (e.g., rebar) opening that defines a connection axis to receive a threaded rod (e.g., rebar) end.

In some examples, a threaded connection can be included on an upper side of the shoe body, opposite the lower rod opening, to secure the shoe body to an upper rod section.

In some examples, as measured along a cross section perpendicular to the connection axis, a first material thickness of the shoe body between the connection axis and the access opening can be between 2 times and 8 times a second material thickness of the shoe body opposite the connection axis from the access opening, inclusive.

Some examples of the disclosed technology provide a column shoe assembly that includes a column shoe secured within cured concrete. A recess box can cover an access opening of the column shoe. The recess box can include threaded openings exposed to the outside of the cured concrete, and threaded fasteners arranged within the threaded openings to urge the recess box away from the column shoe.

Some examples of the disclosed technology provide a method of connecting concrete sections. A first concrete section can be provided with a protruding threaded rod, and a second concrete section can be provided, including a column shoe assembly (e.g., as described above or elsewhere herein). The first and second concrete sections can be aligned to insert the threaded rod into the column shoe assembly. The threaded rod can be secured within the column shoe assembly.

In some examples, a column shoe can be accessed by advancing threaded fasteners of a recess box toward the column shoe.

Some examples of the disclosed technology provide a column shoe assembly. A shoe body can include an internal cavity that is closed continuously around a rear side and at opposite lateral sides by a rear wall and side walls of the shoe body. A lower rod (e.g., rebar) opening can be aligned to receive a first section of rod (e.g., rebar) along a connection axis into the internal cavity. An upper wall can secure to a second section of rod opposite the lower rod opening.

An access opening can open into the internal cavity at a front side of the shoe body, with a rim of the shoe body extending around the access opening. The rim can include, as measured along a cross section perpendicular to the connection axis, a first material thickness that is larger, at a location between the connection axis and the access opening, than a second material thickness of the shoe body along the rear wall.

Some examples of the disclosed technology provide a column shoe assembly. An integrally formed column shoe includes a shoe body that defines an internal cavity with a rear wall, a lower rod (e.g., rebar) opening that opens into the internal cavity and defines a connection axis, a front access opening into the internal cavity on an opposite side of the connection axis from the rear wall, and a thickened rim extending along a perimeter of the front access opening. A first section of rod (e.g., rebar) can extend through the lower rod opening along the connection axis, the first section of rod being threadedly secured within the internal cavity with a threaded fastener can be fully within the internal cavity and accessible via the front access opening for threaded adjustment along the first section of rod. A second section of rod (e.g., rebar) can be secured to an upper side of the shoe body to extend away from the column shoe opposite the lower rod opening.

Some examples of the disclosed technology provide a method of connecting concrete sections. The method can include providing a first concrete section with a first threaded rod protruding from an end of the first concrete section. A second concrete section can be provided with a column shoe assembly embedded therein. The column shoe assembly can include a column shoe with a shoe body that includes an internal cavity with a rear wall, a lower opening that opens into the internal cavity, a front access opening into the internal cavity on an opposite side of the connection axis from the rear wall, and a thickened rim extending along a perimeter of the front access opening. A second rod can be secured to an upper side of the shoe body, opposite the lower opening, and extending from the column shoe within the second concrete section. The first and second concrete sections can be aligned to insert the first threaded rod through the lower opening, along a connection axis, into the internal cavity of the column shoe. The first threaded rod can be threadedly secured within the internal cavity by accessing the first threaded rod within the internal cavity via the front access opening.

BRIEF DESCRIPTION OF THE DRAWINGS

The accompanying drawings, which are incorporated in and form a part of this specification, illustrate examples of the disclosed technology and, together with the description, serve to explain the principles of examples of the disclosed technology.

DETAILED DESCRIPTION

Figure 1:
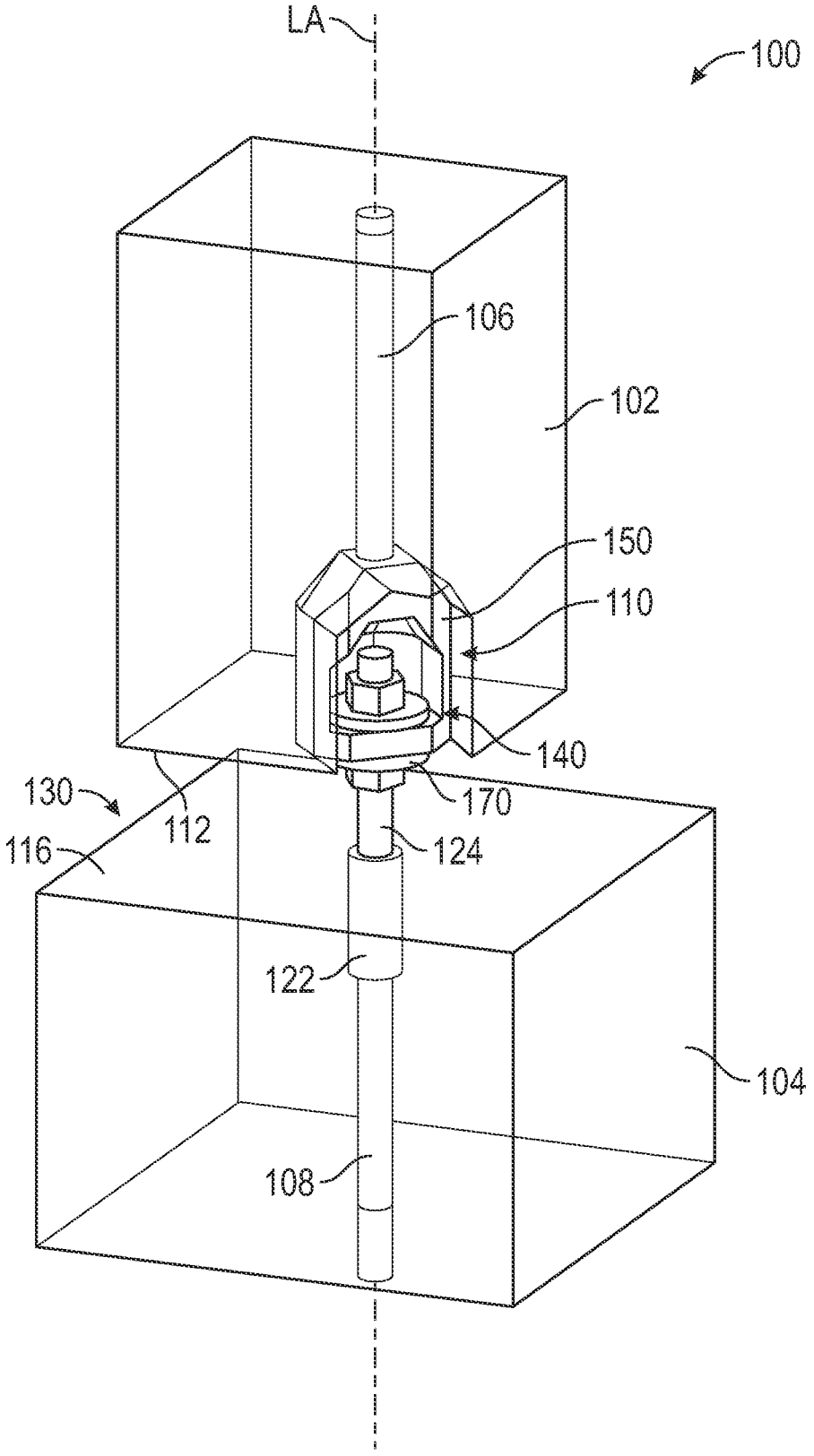
FIG. 1 is an axonometric view of a connection system according to an example of the disclosed technology, including a column shoe assembly that connects concrete sections (rendered transparently to show features of the column shoe assembly)

Before any examples of the disclosed technology are explained in detail, it is to be understood that the disclosed technology is not limited in its application to the details of construction and the arrangement of components set forth in the following description or illustrated in the following drawings. The disclosed technology is capable of other examples and of being practiced or of being carried out in various ways.

The following discussion is presented to enable a person skilled in the art to make and use examples of the disclosed technology. Various modifications to the illustrated examples will be readily apparent to those skilled in the art, and the generic principles herein can be applied to other examples and applications without departing from examples of the disclosed technology. Thus, examples of the disclosed technology are not intended to be limited to examples shown, but are to be accorded the widest scope consistent with the principles and features disclosed herein. The following detailed description is to be read with reference to the figures, in which like elements in different figures have like reference numerals. The figures, which are not necessarily to scale, depict selected examples and are not intended to limit the scope of examples of the disclosed technology. Skilled artisans will recognize the examples provided herein have many useful alternatives and fall within the scope of examples of the disclosed technology.

In some construction operations, reinforced concrete is pre-cast at a prefabrication site (e.g., a dedicated facility) to form a section of a structure (e.g., walls or columns). Various sections can then be transported to an installation site to be joined together into a larger assembled structure, typically with various rebar connectors used to join the rebar of adjacent sections of the concrete.

Some concrete sections in particular can be configured as columns, to be stacked onto supporting foundations to assemble a larger structure (e.g., stacked onto a foundation provided by an earlier-installed column). However, a variety of section forms are possible. Correspondingly, discussion of columns in particular examples herein can generally apply to a variety of other concrete sections, in some cases.

When pre-cast columns (for example) are added to existing structure, the columns may need to be adjusted into a final alignment (e.g., to be plumb). Embedding column shoes into the columns can provide one way of making these adjustment. With this approach, threaded rods embedded in a base section extend upwardly from the base to receive threaded nuts (and washers, etc., as appropriate). A column can be lowered onto these rods, so that the threaded rods are received into column shoes within the column, and the column shoes are seated on the nuts (or washers, etc.). With the column shoes thus seated, the nuts can then be adjusted, as needed, until the column is appropriately aligned. Finally, another nut can be secured on the threaded rod above the column shoe to lock the column shoe, and the column, in place. With the column shoe assembly thus secured, if the column shoes and associated parts (e.g., nuts and threaded rods) are strong enough, other support for the column can then sometimes be removed before any required mortar cures, without adding any additional bracing.

Examples of the disclosed technology can provide improved column shoe assemblies for concrete structures. For example, some configurations can include improved connections between rebar (or other rods) and column shoe bodies and improved structural configurations for load distribution during transfer of loads between assembled concrete structures (e.g., via load paths extending through structures of, or attached to, a column shoe).

In some configurations, column shoes can be connected with threaded connections to rebar (or other rod) sections within the corresponding pre-cast concrete sections. Some arrangements can allow coaxial alignment between rebars (or other rods) on opposed sides of the column shoe, with corresponding improvements in load bearing in concrete assemblies.

In some configurations, column shoe bodies can have improved distribution of material thickness for load distribution and access, including with off-centered material distribution as indicated by varied material thickness at different locations with a horizontal cross-section. (As used herein, reference to material thickness refers to a thickness measured locally perpendicular to an inner or outer surface of a body (e.g., an internal wall of a cavity of column shoe).) For example, relative to a cross-section perpendicular to a loading axis, some configurations can include 2 to 8 times greater wall thickness at a first (e.g., front) side of a column shoe than at an opposed second (e.g., back) side. Thus, for example, column shoe walls may be 2 to 8, or 3 to 5 times thicker on one side of an axis of load transmission. In some examples, in particular, part or all of a rim at a front access opening of a column shoe can exhibit material thickness that is 2 to 8 times (or otherwise) greater than a material thickness at a rear wall of the column shoe.

In various combinations (e.g., alone or together), these and other features disclosed herein can provide improved column shoe assemblies and corresponding concrete structures, as compared to conventional systems. For example, some column shoe assemblies (and column shoes) as disclosed herein can be rated at full rebar (or rod) strength, while still requiring relatively low material usage and providing easy access for adjustments of assembled structures.

As also generally noted above, discussion herein applies generally to assembly of prefabricated concrete sections, and examples of the disclosed column shoes can be used to secure a wide variety of concrete forms together. Some examples may be particularly useful for securing and aligning column sections. In this regard, the figures presented herein illustrate example column shoes as part of pre-cast columns that are mounted on simple bases (e.g., rectangular foundations). However, column shoes according to this disclosure (e.g., as shown in the figures) can be used in other types of concrete sections, including as part of a foundation, as part of a pre-cast wall, etc. Correspondingly, discussion herein of foundations is generally applicable to concrete sections of a variety of types, including other columns, walls, etc. that are arranged, relatively, as a base to support a section that includes a column shoe.

FIG. 1 illustrates an example connection system 100 that connects a first concrete section 102 of a concrete structure and a second concrete section 104 of a concrete structure (e.g., a column and a foundation, respectively), along a longitudinal axis LA. The first section 102 includes a first rebar 106 extending along the longitudinal axis LA within the first section 102 and the second section 104 includes a continuation bar (e.g., second rebar 108) extending along the longitudinal axis LA within the second section 104. The first section 102 includes an opening 110 disposed adjacent to a lower surface 112 of the first section 102, e.g., at a corner as shown. As further discussed below, the opening 110 provides access to a column shoe 150 of a column shoe assembly 140 embedded within the first section 102. As similarly noted below, although the sections 102, 104 are illustrated and described in particular as having the rebar 106, 108, alternate configurations can include other forms of threaded rods. Correspondingly, discussion herein of the rebar 106, 108 can apply equally to other rods (e.g., with a threaded rod end protruding from the second section 104 or engaged with the column shoe 150 within the first section 102).

The second section 104 includes an upper face 116 that is arranged opposite the lower surface 112 of the first section 102, and generally includes one or more protruding threaded rods. In some examples, a foundation may include a protruding threaded rod at each corner or in various other spatial arrangements, to engage with corresponding column shoes in a supported section. In the example shown, the second section 104 includes an adapter 122 (e.g., a threaded coupler, as shown) at which a protruding threaded rod (e.g., threaded rebar 124) can be secured. However, a threaded rod (e.g., the threaded rebar 124) may be otherwise tied to the section 104 (e.g., directly embedded therein).

In this regard, threaded rods in general can include a variety of configurations. For example, some threaded rods can be all-thread rods with a threaded portion integrally machined along an entire length of the rod. Other threaded rods can be threaded only along part of a length of the rod (e.g., at one or both ends of a section of rebar). Correspondingly, discussion or illustration of a particular type of threaded rod (e.g., rebar) in some examples below should not be regarded as limiting.

With the threaded rebar 124 received into the column shoe assembly 140 and the column shoe 150 seated on a nut 170 or other suitable fastener, the first section 102 and the second section 104 of the concrete structure may be separated by a gap 130. A height of the gap 130 may be adjusted before or after installing the section 102, by adjusting the nut 170 (or other fastener(s)) along the threaded rebar 124.

In the example shown, the second rebar 108 extends upward along the longitudinal axis LA and is substantially coaxially aligned (e.g., concentric with) the first rebar 106. As also discussed below, such an alignment between the rebars can beneficially allow force to be transmitted into, through, and out of a column shoe assembly along a single axis (e.g., the central longitudinal axis LA, as shown for the column shoe assembly 140). In contrast, conventional designs typically result in axial misalignment between rebars above and below a column shoe, with correspondingly detrimental loading patterns.

Generally, a column shoe can be formed as an integral casting (or otherwise) using a variety of suitably strong materials (e.g., ductile iron, tempered ductile iron, etc.). A body of a column shoe can also take a variety of forms, including those with improved material distribution as further discussed below.

Figure 2:
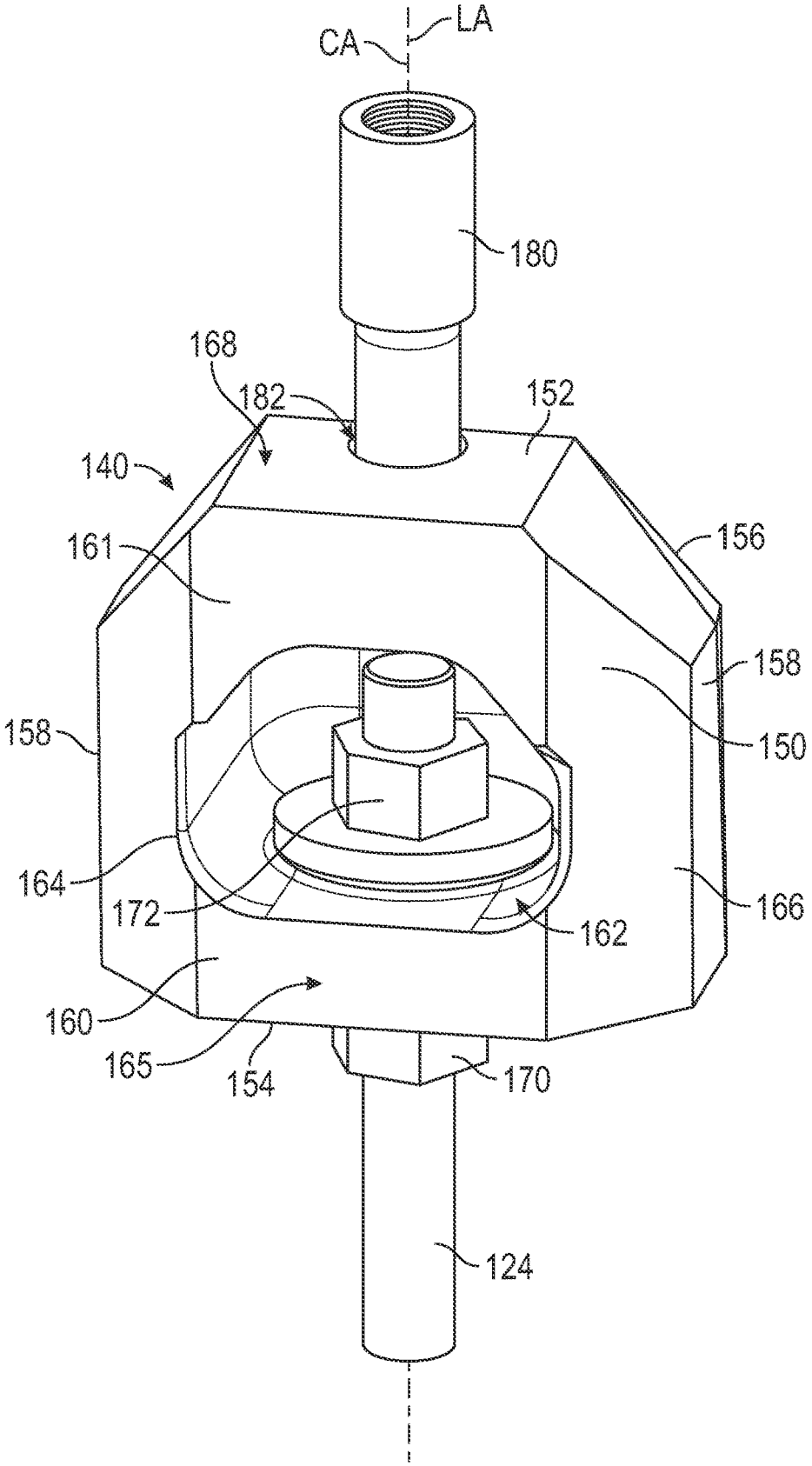
FIG. 2 is an axonometric view of the column shoe assembly of FIG. 1 according to an example of the disclosed technology.

Referring now to FIG. 2, an example configuration of the column shoe 150 includes a top wall 152, a bottom wall 154, a rear wall 156, side walls 158, and a front wall 160 which defines a shoe body 161. The front wall 160 includes a front access opening 164 that opens into an internal cavity 162, and a lower rebar opening 184 (see FIGS. 3A and 3B) to receive the threaded rebar 124. The internal cavity 162 is closed continuously around a rear side and at opposite lateral sides by the rear wall 156 and the side walls 158 of the shoe body 161 and the shoe body 161 can thus exclude concrete from the internal cavity if the access opening 164 is blocked (e.g., as further discussed below). The lower rebar opening 184 is aligned to receive a first section of rebar 124 along a connection axis CA into the internal cavity 162, and the connection axis CA can be aligned coaxially with the longitudinal axis LA.

The access opening 164 can provide access to secure a nut 172—and thereby the column shoe 150—onto the rebar 124 and thereby tie the embedded rebars 106, 108 together via the column shoe 150. In particular, the access opening 164 opens into the internal cavity 162 from a front surface at a front side 165 of the shoe body 161 (i.e., along the front wall 160, as shown).

In some examples, the front wall 160 and the side walls 158 defines a rim 166 of the shoe body 161 that extends around the access opening 164. In this regard, a relatively large size for the access opening 164 (and the cavity 162) may be preferred, to provide maximum clearance for adjustment relative to a supporting section.

The cavity 162 generally includes rounded internal corners to provide improved stress distributions during axial loading. The cavity 162 is also generally larger than the nut 172 to accommodate different tools to fasten the nut 172, and an internal surface of the bottom wall 154 may be flat in order to be flush with a corresponding washer.

Figure 3B:
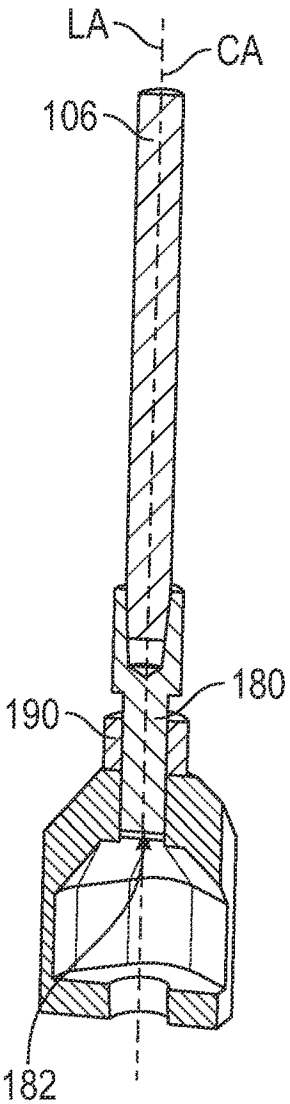
FIGS. 3A and 3B are axonometric and vertical cross-section views of a column shoe and a rebar connection for the column shoe assembly of FIG. 1.
Figure 3A:
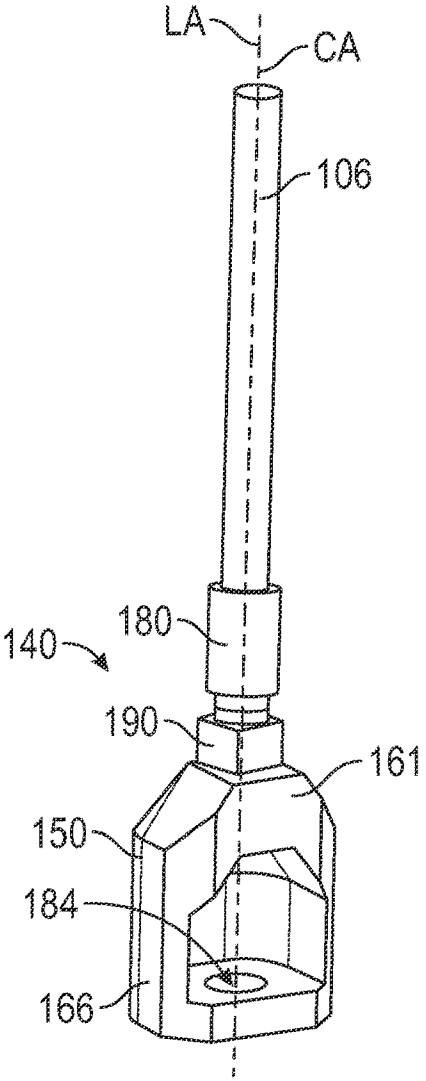

In different examples, different arrangements can be used to secure rebar of a concrete section to a column shoe embedded in the concrete. Generally, a rebar of the concrete section can be secured at an upper side 168 of the shoe body 161, opposite of the lower rebar opening 184. As shown in FIGS. 3A and 3B in particular, a threaded hole 182 in (e.g., through) the top wall 152 may receive a threaded end of an adapter 180. The adapter 180 can in turn be secured to the first rebar 106 (e.g., with a tapered threaded connection as shown, or otherwise). In other words, the threaded adapter 180 forms a threaded connection with a section (e.g., threaded end) of the first rebar 106 and with the column shoe 150, although other types of adapters or other connections (e.g., without threads) are possible. Thus, for example, the rotational and axial position of the column shoe 150 can be adjusted, relative to the rebar 106, then locked in place with a further nut 190.

As another example configuration, the rebar can be directly connected to a column shoe. For example, as shown in FIGS. 4A and 4B, the first rebar 106 can be threaded (e.g., with a tapered thread, as shown) and can thus be engaged with a corresponding thread in the hole 182 (e.g., also tapered, as shown).

Alternatively, the rebar 106 can be otherwise secured to the column shoe 150. In some examples, the rebar 106 and the column shoe 150 can be secured together using a coupler or other fastening mechanism. For example, a coupler can be secured to a column shoe (e.g., bolted or welded thereto, or integrated therewith), and set screws or other fasteners then used to secure the rebar 106 to the coupler. In some examples, the rebar 106 and the column shoe 150 can be welded together.

Figure 4B:
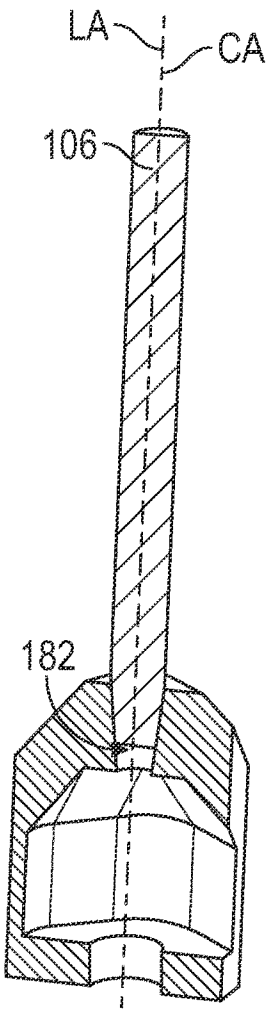
FIGS. 4A and 4B are axonometric and vertical cross-section views of a column shoe and another rebar connection for the column shoe assembly of FIG. 1.
Figure 4A:
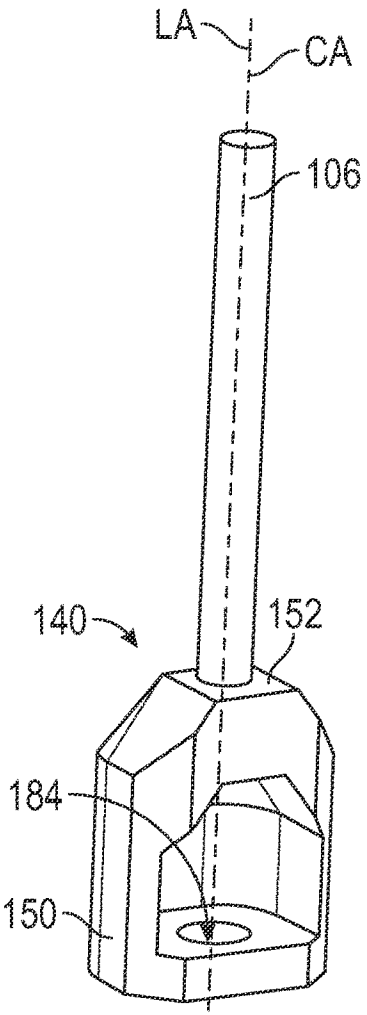

In either case, as shown in FIGS. 3B and 4B in particular, the first rebar 106 can be secured to the column shoe 150 in coaxial (or substantially coaxial) alignment with the lower rebar opening 184. Thus, the first rebar 106 can be similarly aligned with the second rebar 108, as received into the column shoe 150 through the lower rebar opening 184 (see also FIG. 1). In other words, the first rebar 106 (e.g., as secured by the threaded adapter 180) and the second rebar 108 can be aligned substantially coaxial with the connection axis CA. Correspondingly, tension loading through the rebar 106 and the rebar 108, as transferred across the column shoe 150, can extend coaxially along the longitudinal axis LA.

Figure 5:
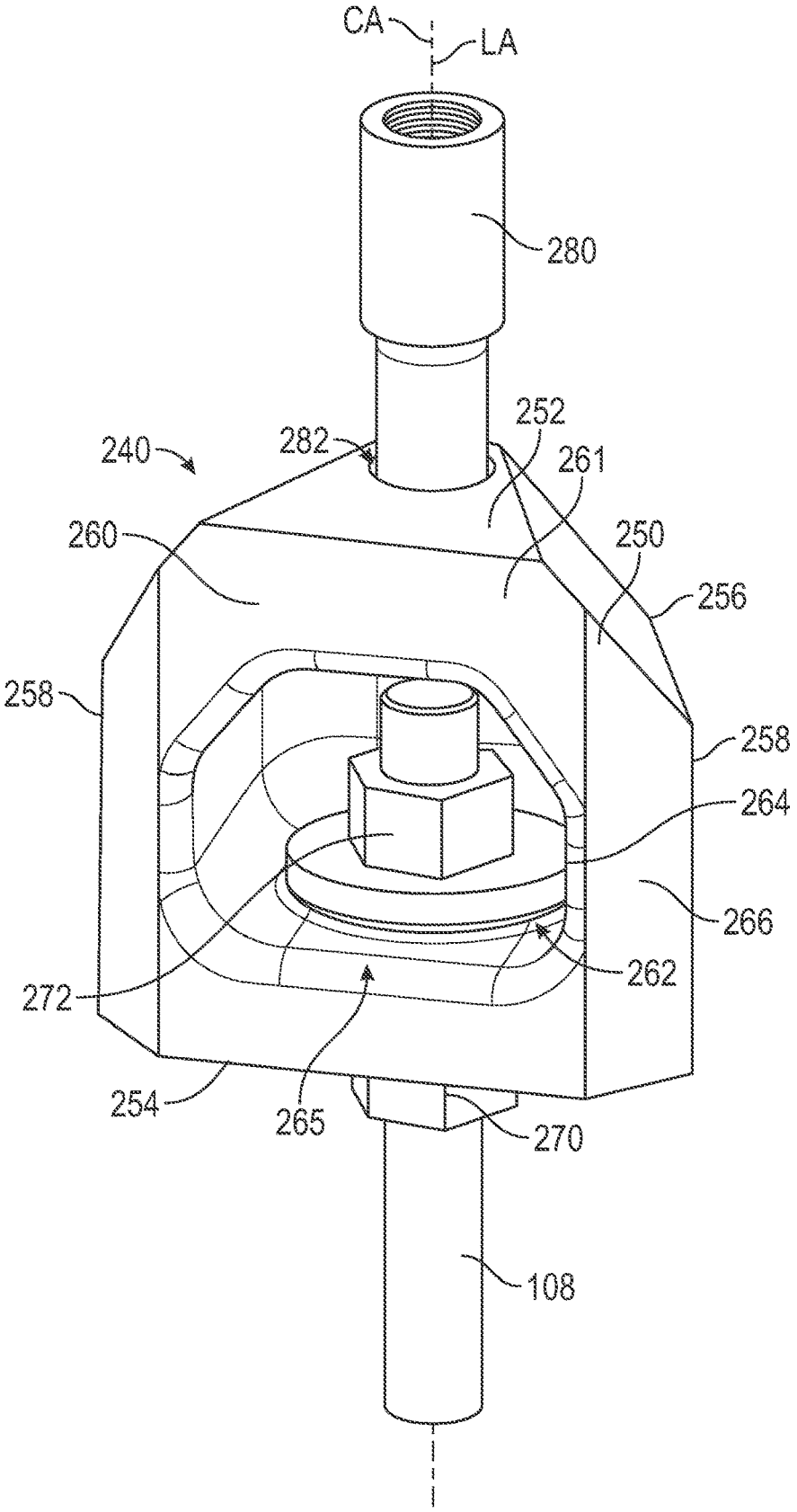
FIGS. 5 and 6 are axonometric views of the column shoe assembly of FIG. 1 according to still other examples of the disclosed technology.

Referring now to FIG. 5, another example column shoe assembly 240 is shown. In many aspects, the column shoe assembly 240 is similar to the column shoe assembly 140 described above. Correspondingly, similar numbering in the 200 series is used for the column shoe assembly 240 and discussion of numbered features of the assembly 140 similarly apples to the assembly 240. For example, the column shoe assembly 240 includes a column shoe 250 with a top wall 252, a bottom wall 254, a rear wall 256, side walls 258, and a front wall 260, etc. Further, as similarly discussed for the column shoe assembly 140, the column shoe 250 can be secured to rebar in various ways.

In comparison to the column shoe 150, however, and as further discussed below, the column shoe 250 includes a reduced wall thickness along various sections. Thus, the column shoe 250 can provide reduced weight, as compared to the column shoe 150, without significant loss of structural strength.

Figure 6:
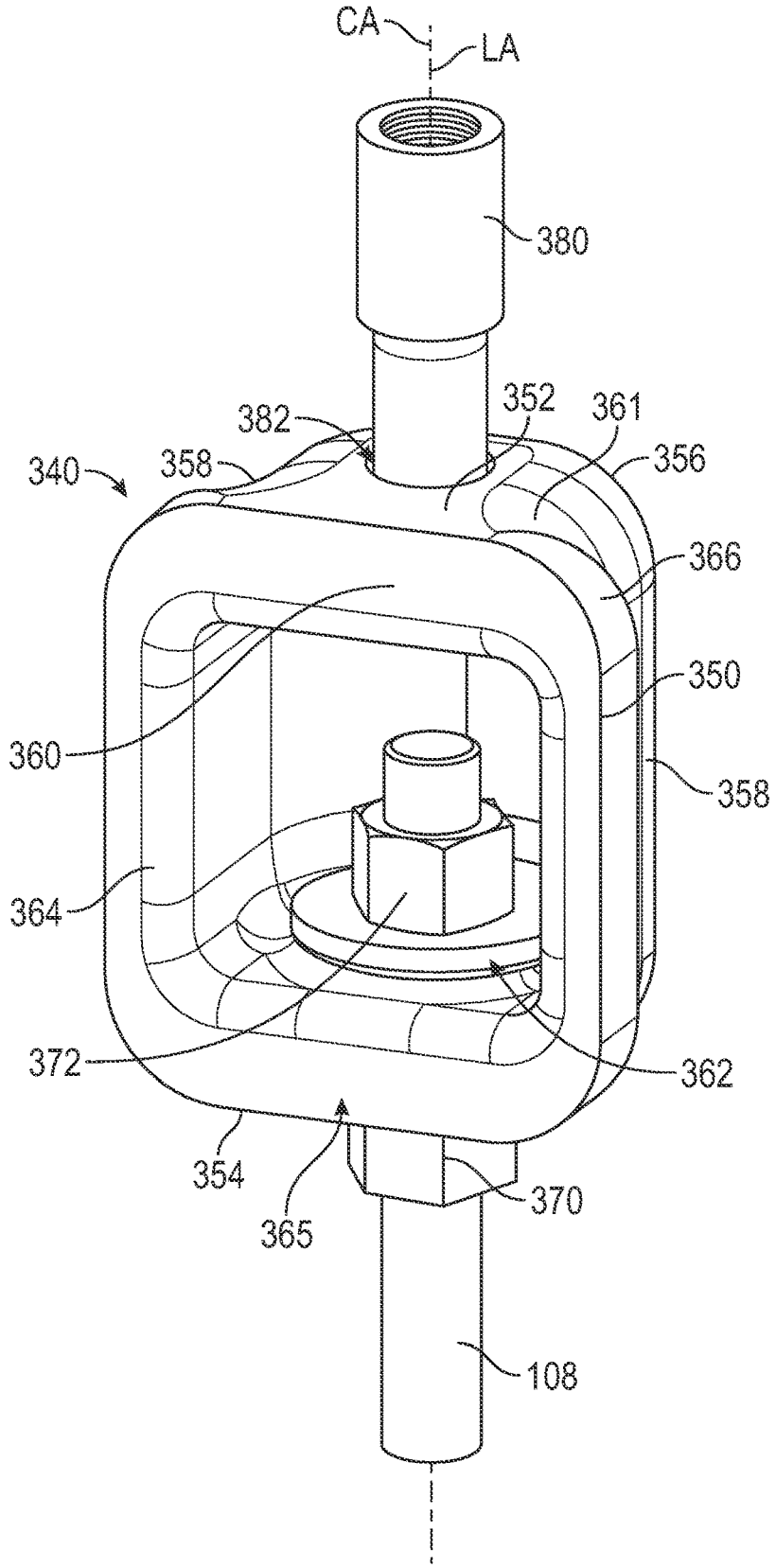

Referring now to FIG. 6, still another example column shoe assembly 340 is shown. In many aspects, the column shoe assembly 340 is similar to the column shoe assemblies 140, 240 described above. Correspondingly, similar numbering in the 300 series is used for the column shoe assembly 340 and discussion of numbered features of the assembly 140, 240 similarly apples to the assembly 340. For example, the column shoe assembly 340 includes a column shoe 350 with a top wall 352, a bottom wall 354, a rear wall 356, side walls 358, and a front wall 360 that define an internal cavity 362, etc.

In comparison to the column shoes 150, 250, however, the column shoe 350 includes a still further reduced wall thickness along various sections. Thus, the column shoe 350 can provide reduced weight, as compared to the column shoes 150, 250, without significant loss of structural strength. Additionally, the column shoe 350 can exhibit an access opening 364 that is larger than the openings 164, 264 (e.g., wider or taller), as can correspond to a larger size for the internal cavity 362 or otherwise provide for improved adjustment and securement of the column shoe assembly 340 (e.g., using a wrench or other hand tool (not shown) inserted into the column shoe via the access opening 364).

Figure 7:
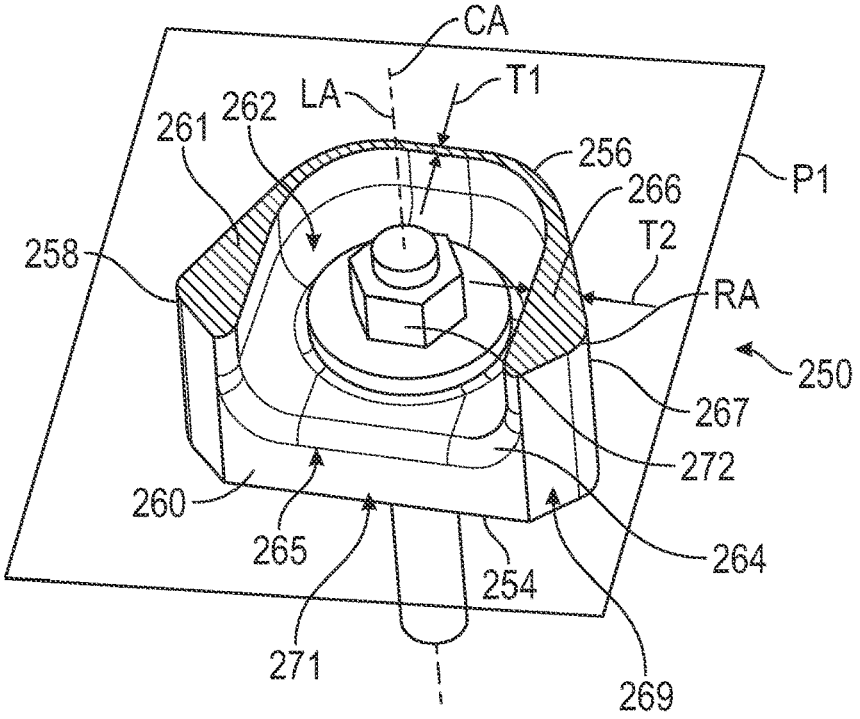
FIG. 7 is a cross-section view of the column shoe assembly of FIG. 5 taken along a horizontal plane.

As generally discussed above, particular configurations of material thickness around an internal perimeter of a column shoe cavity can provide particularly improved column shoes. In this regard, FIG. 7 illustrates a cross-sectional view of the column shoe assembly 240 of FIG. 5, taken along a cross sectional plane P1 that is perpendicular to the longitudinal axis LA. Along the cross-sectional plane P1, the integral body of the column shoe 250 exhibits a varying wall thickness, as measured (locally) perpendicular to an internal perimeter of the internal cavity 262.

In particular, for the example shown, wall thickness is greater toward a front (or access) side 265 of the column shoe 250 and is less toward a rear (or closed) side of the column shoe 250. Or, more generally, wall thickness is generally greater on one side of the longitudinal axis LA than on another (e.g., the front side rather than the back). Thus, for example, the rear wall exhibits a first material thickness T1 that is significantly smaller than a second material thickness T2 exhibited by the side walls 258. In some examples, a maximum or mean value of the thickness T2 may be between 2 and 8 times greater than a maximum or mean value of the thickness T1, respectively (e.g., in particular, between 3 and 5 times greater).

In some examples, the thickness T2 varies along relevant side walls (e.g., between a front and a rear of the column shoe). For example, as shown in FIG. 7, the thickness T2 can be generally thinner toward the rear wall 256 and generally thicker toward the front wall 260 (or the front opening 264). Thus, for example, the side walls 258 can provide a thickened rim that surrounds the access opening 264, while walls on a different (e.g., opposite side) of the longitudinal axis can be generally thinner. In particular, a maximum location of the second material thickness T2 can be rearward of the front side 265 of the shoe body 261 that surrounds the access opening 264 and forward of the connection axis CA (e.g., at an apex location 267, as shown). In this regard, material can be beneficially concentrated to provide increased strength along axes that are offset outwardly from the connection axis. Thus, for example, a column shoe assembly may utilize relatively little material overall while also providing relatively high axial tension and compression strength for the column shoe (e.g., the shoe 250) and the associated concrete section, with increased moment strength for the concrete section overall. Further, the concentration of material at the thickened rim can result in material savings overall, with corresponding benefits for ease of installation and production costs.

In some configurations, the thickness T2 can taper to be thinner closer to a front opening than at a location of maximum thickness (e.g., at a location between the front opening 264 and the longitudinal axis LA). As illustrated in the example of FIG. 7, in particular, the thickness T2 tapers continuously and linearly along the side wall 258, between the rear wall 256 and a location of maximum thickness (e.g., at the apex location 267, as shown).

Similarly, in some examples, a front face 269 of the rim 266, along the front side 265 of the column shoe 250, can extend rearwardly from a front face 271 of the shoe body 261, toward a maximum location of the material thickness T2. For example, as shown in FIG. 7, the front face 269 angles rearwardly at a constant angle relative to a plane defined by the access opening 264 or the front face 271. Thus, in particular, the distance between the connection axis CA and the sides of the relevant concrete section can be minimized at corners, with corresponding improvement in overall strength of the concrete installation. Further, as also discussed below, such a rearwardly extending surface can generally provide improved access for later adjustment of fasteners within the column shoe 250.

As illustrated, the wall thickness T2 can change generally linearly between the rear wall 256 and the front wall 260 (e.g., with a single maximum value at the location 267 between the connection axis CA and the front side 265 of the column shoe 250), although other configurations are possible. Further, some examples, can include internal voids or other structures as appropriate (e.g., as produced using optimized additive manufacturing designs).

Figure 8:
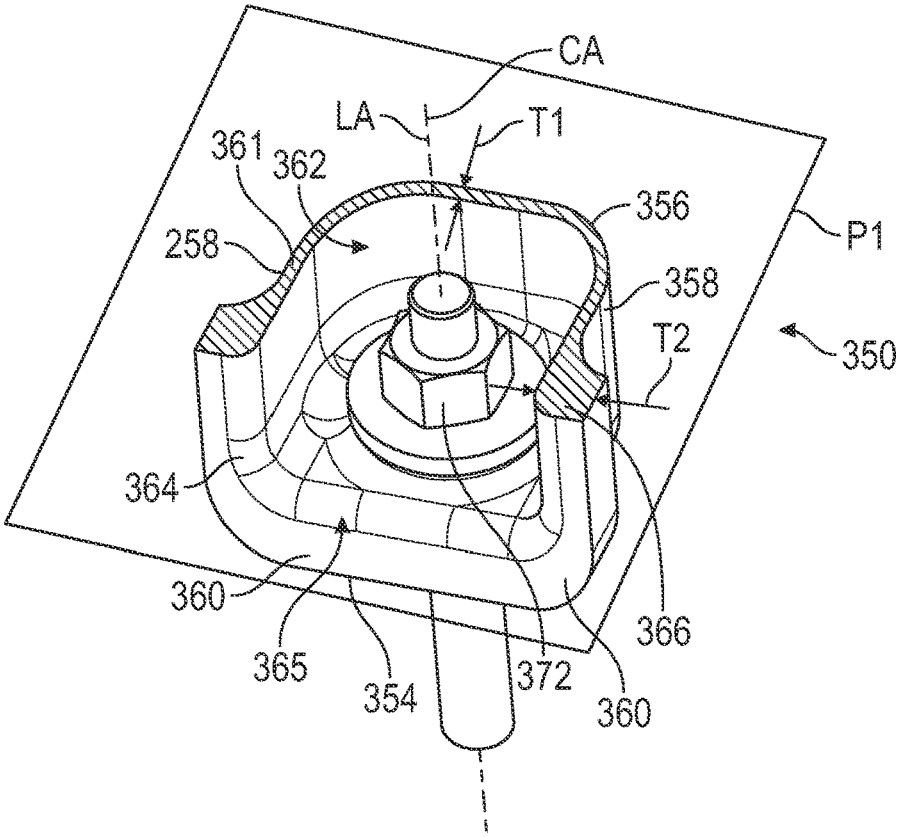
FIG. 8 is a cross-section view of the column shoe assembly of FIG. 6 taken along a horizontal plane.

FIG. 8 illustrates a cross-sectional view of the column shoe 350 of FIG. 6. Similarly to the column shoe 250, the column shoe includes a rim 366 that provides larger wall thickness T2 toward the opening 364 (e.g., at the opening 364, as shown), as compared to a wall thickness T1 along the rear wall 356. In the example shown, the thickness T2 extends with a constant (or substantially constant) value rearward of a front side 365 of the shoe body 261 that surrounds the access opening 164. In particular, a maximum location of the second material thickness T2 can be rearward of (or located at) a surface at the front side 365 of the shoe body 361 that surrounds the access opening 364, while also being forward of the connection axis CA. In particular, a maximum or mean value of the thickness T2 for the column shoe 350 along the side walls 358 (e.g., adjacent the opening 364) may also be between 2 and 8 times greater than a maximum or mean value of the thickness T1, respectively (e.g., in particular between 3 and 5 greater).

In contrast to the column shoe 250, the side walls 358 of the column shoe 350 exhibit a more pronounced thickened rim around the access opening 364, with relative thin sections extending rearward therefrom. In particular, in the illustrated example, the relatively small thickness T1 extends from the rear wall 356 onto the side walls 358, then along the side walls 358 to a forward side of the longitudinal axis LA, where the side walls 358 widen relatively abruptly to the relatively uniform larger thickness T2. In other examples, however, other configurations are possible, including with differently shaped thickened rims.

Thus, the design of both of the column shoes 250, 350 can concentrate a relatively large amount of material of the column shoe 350 forward of the longitudinal axis LA (e.g., onto the rim around the access opening 364, in particular). Correspondingly, relative to expected loads during service, the column shoes 250, 350 FIG. 6 may provide a better strength-to-weight ratio in comparison to the column shoe 150, as well as various conventional column shoes.

In some examples, the first material thickness T1 can be between about 3/16" and about ½" or between about 3/16" and about ¾". In some example, the second material thickness can be between about ¾" and about 1¼", or between about 1" and about 1¼".

Figure 9A:
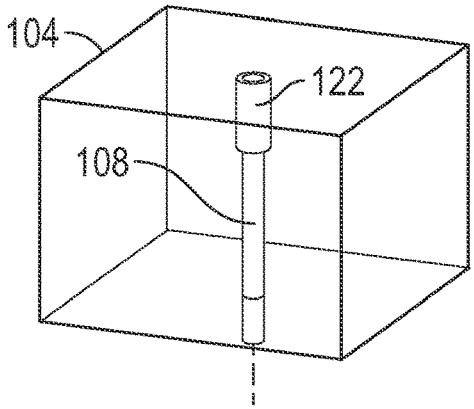
FIGS. 9A-9F are axonometric views of installing the column shoe assembly of FIG. 1 taken along a horizontal plane.
Figure 9B:
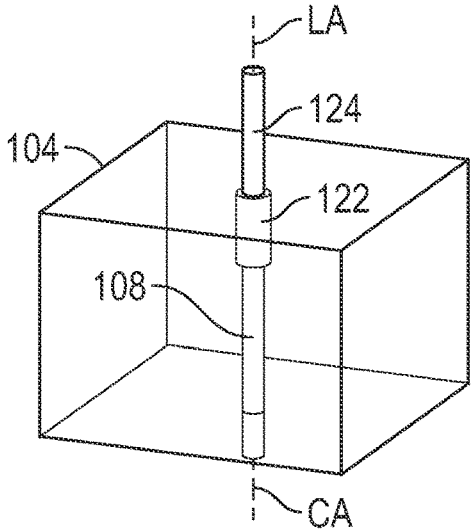
Figure 9C:
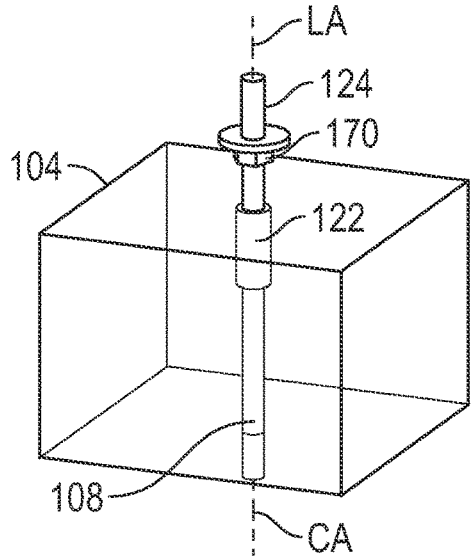

A method of using the column shoe assembly 140 of FIG. 2 in concrete construction is illustrated in FIGS. 9A-9F. Although the assembly 140 is shown in particular, similar operations can be used for other column shoe assemblies than the example shown, including those with other column shoe bodies (e.g., as with either of the column shoes 250, 350, as presented above). Referring to FIG. 9A, concrete for the second section 104 can be set, with the rebar 108 and the adapter 122 (as needed) embedded therein. As shown in FIG. 9B, the threaded rebar 124 can then be engaged with the adapter 122 (as needed) to protrude proud from the section 104. Referring to FIG. 9C, the nut 170 can be threaded onto the threaded rebar 124 and adjusted to an approximate end position (e.g., with a washer supported thereon, as shown).

Concrete for the first section 102 can be similarly set around the rebar 106 and the column shoe 150. Then, referring to FIGS. 9D and 9E, the first section 102 can be lifted onto the second section 104, to receive the threaded rebar 124 into the internal cavity 162 and thereby seat the column shoe 150 on the nut 170 (e.g., with direct support via the washer, as shown). Thus, the first section 102 can be supported on the second section 104 using the column shoe assembly 140 (e.g., in combination with various other shoe assemblies, as generally discussed above). Further, the nut 170 can be adjusted as needed (e.g., to plumb the first section 102 with the second section 104).

Once the sections 102, 104 are appropriately seated and aligned, the nut 172 can be secured onto the threaded rebar 124 via the access opening 164 (e.g., using a wrench or other hand tool, not shown). This can correspondingly secure the column shoe 150 to the threaded rebar 124 and thus tie together the rebar 106, 108 and the sections 102, 104. In particular, the nut 172 can be tightened to secure the threaded rebar 124 the internal cavity 162 via access through the access opening 164 along the front wall 160 (e.g., also through a cavity left by removal of a recess body, as further discussed below). Thus installed, the column shoe assembly 140 can transmit both tension and compression loads between the first and second sections 102, 104, while allowing easy and relatively fine adjustments in alignment between the sections 102, 104.

Figure 9F:
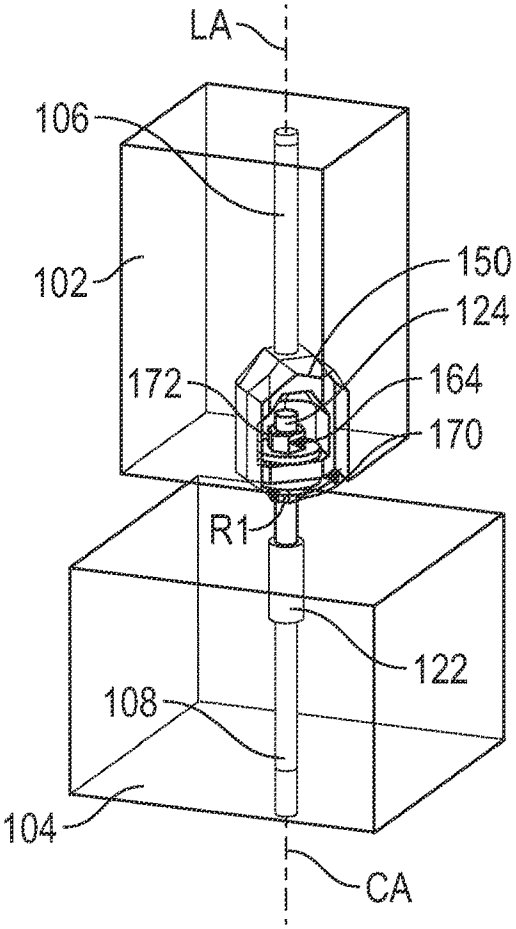
Figure 9E:
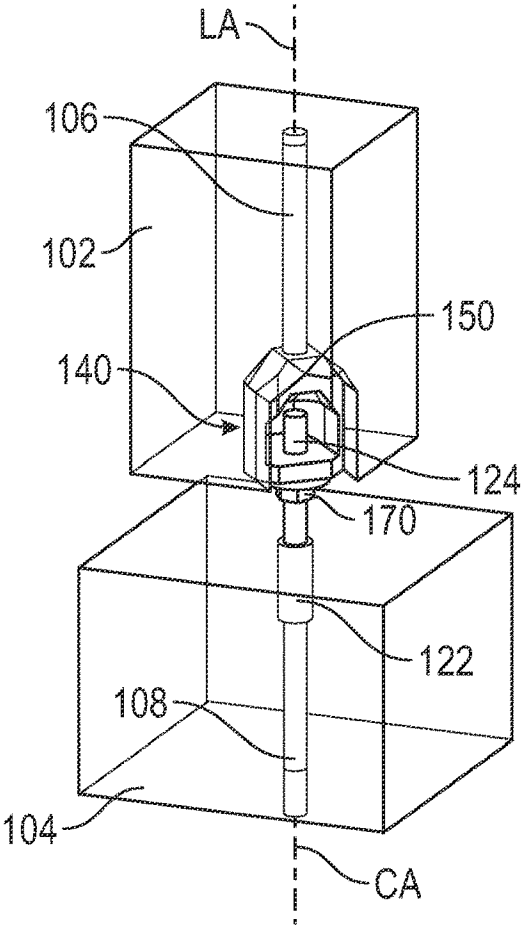
Figure 9D:
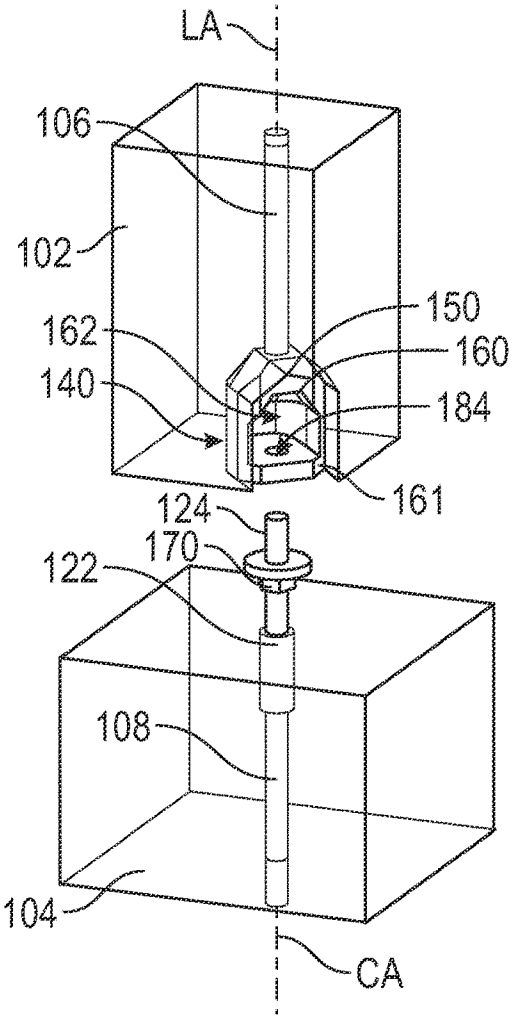

As noted above, some column shoes can include rearwardly extending (e.g., angled) front faces, including along a thickened front rim that surrounds a front access opening of the relevant column shoe. As illustrated in FIG. 9F, the rearwardly angled orientation of front faces of the column shoe 150 can provide relatively large clearance for manipulation of a hand tool within the access opening 164, corresponding to a relatively large range R1 of rotational movement for the hand tool. In particular, for example, the rearward angled faces of the column shoe 150 can provide sufficient clearance so that the concrete of the section 102, rather than the column shoe 150, defines the limits in the rotational range R1 for a given tool engaged with the nut 170 (e.g., standard crescent wrench). Further, similar benefits can also be achieved with other rearwardly extending rim front faces, including with the configuration illustrated in FIG. 7. Thus, for example, an angled or otherwise rearwardly extending rim can allow for more efficient operations to secure concrete sections together, as well as providing improved overall structural strength with relatively high strength-to-weight efficiency.

Figure 10A:
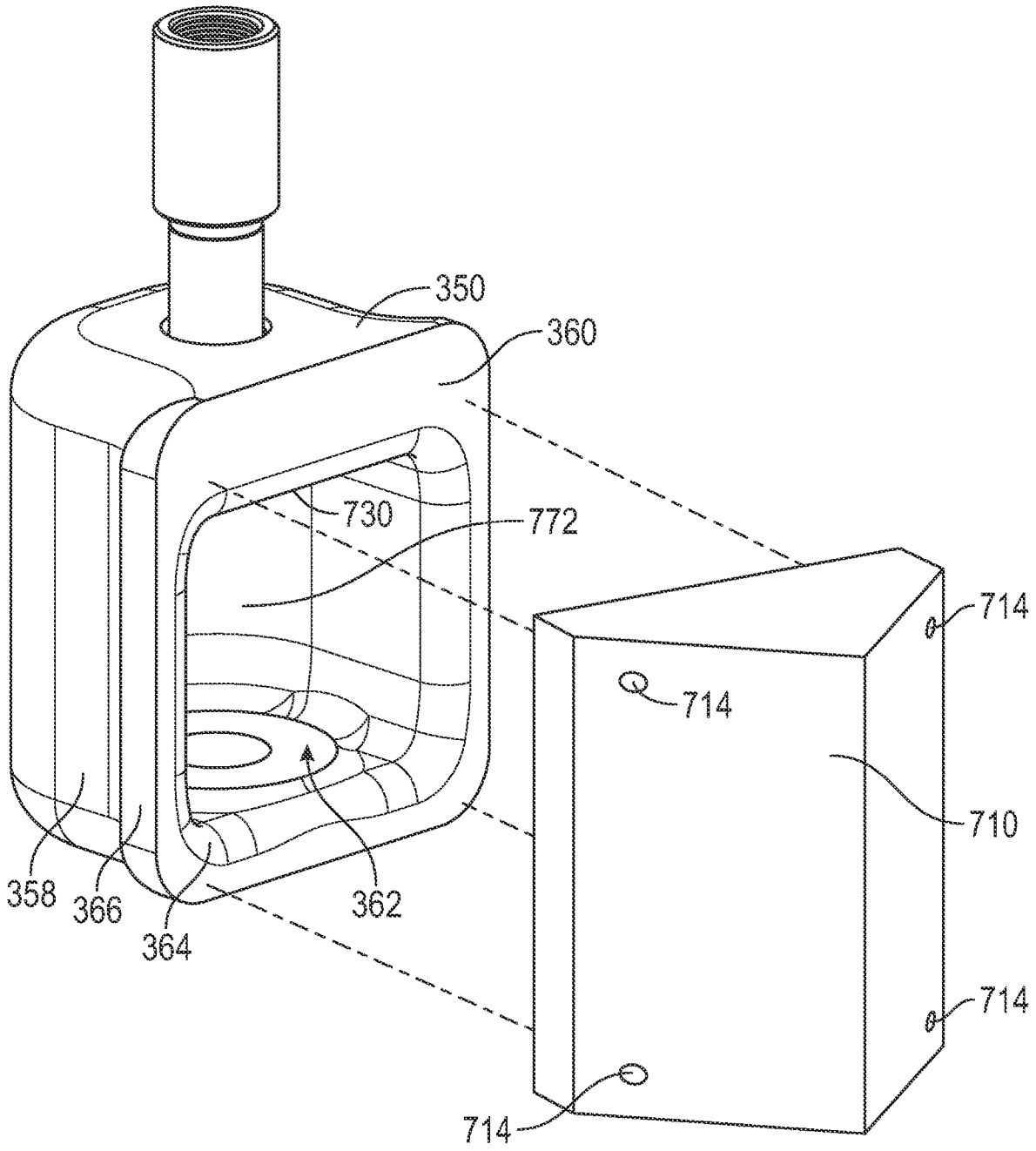
FIG. 10A is an isometric view of the column shoe assembly of FIG. 6, including a recess box.
Figure 11A:
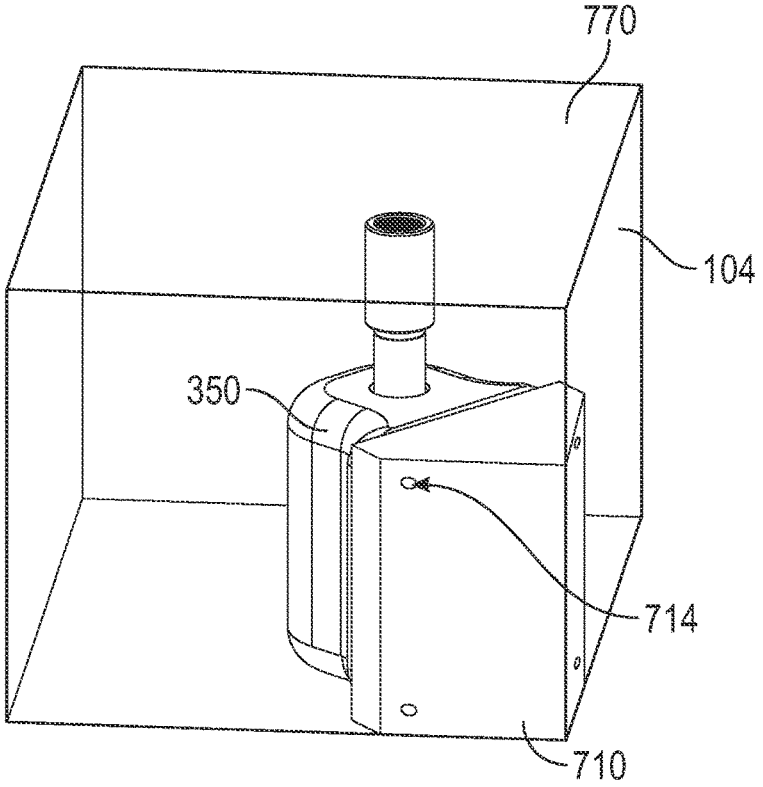
FIGS. 11A and 11B are axonometric views of a method of removing a recess box to access a column shoe.

Generally, an opening may need to be provided in a concrete section for access to a column shoe (e.g., the opening 110 of FIG. 1), to expose to operators the front access openings for any of the column shoes discussed above, or others. Such an opening can be formed by placing a recess box or other recess body adjacent the column shoe, prior to casting the relevant structure (e.g., column, wall, foundation, etc.). In some examples, a recess body can be arranged to removably cover an access opening in a column shoe to prevent ingress of concrete into the shoe body via the access opening (e.g., relative to the access opening 364 of the column shoe 350 as shown in FIG. 10A, relative to the access opening 264 of the column shoe 250, or otherwise). In the illustrated example of FIG. 10A, a recess box 710 includes a non-rectangular geometry configured to generally conform to the adjacent exterior profile of the relevant concrete section (e.g., a corner profile as shown in FIG. 11A), but various other box shapes or other recess body geometries are possible.

In some examples, a recess body may support a plurality of fasteners arranged to be advanced relative to the recess body (e.g., through corresponding holes) to urge the recess body away from the relevant column shoe. In some examples of the disclosed technology, one or more threaded holes or other features can be included in a recess box to facilitate easier removal of the recess box, after the concrete is set, to access the column shoe. Referring again to FIG. 10A, for example, a recess body 710, formed as a solid recess box, includes a plurality of threaded holes 714 (e.g., four as shown, although different numbers are possible). The threaded holes 714 can receive threaded bolts (not shown) or other threaded fasteners, which can then be tightened to push against the front wall of a column shoe and thereby urge the recess body 710 away from the column shoe for removal from the concrete section in which the column shoe 350 is embedded. For example, as shown in FIG. 10A, fasteners (not shown in FIG. 10A) that extend through the holes 714 can be aligned to contact a rim 366 of the column shoe 350 at the front wall 360 (e.g., or similarly contact the front walls 160, 260 of the column shoes 150, 250).

Figure 10B:
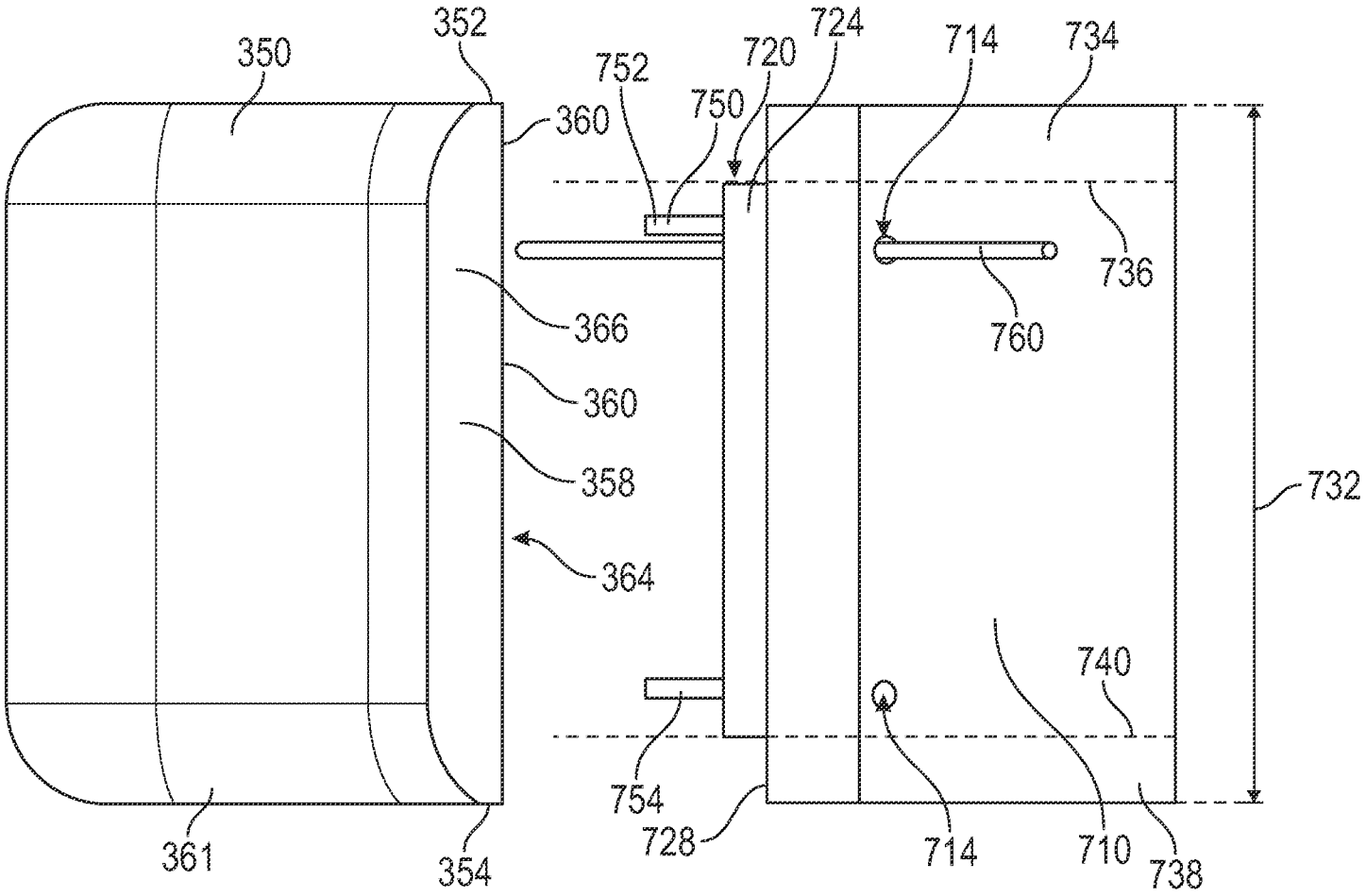
FIG. 10B is a side elevational view of the assembly of FIG. 10A with an example configuration of the recess box.

Referring now to FIG. 10B, the column shoe 350 and the recess body 710 can in some cases be secured together using one or more attachment features 720 (illustrated schematically in FIG. 10B). In the illustrated example, the recess body 710 includes a boss 724 that extends away from an inner surface 728 of the recess body 710. The boss 724 is configured to fit into the front opening 364 of the column shoe body 361, to locate and secure the recess body 710 relative to the column shoe 350. In some examples, an outer perimeter of the boss 724 can seat along an inner perimeter 730 (see FIG. 10A) of the access opening 364 of the column shoe 350 (e.g., being sized for press-fit engagement within the access opening 364). Such an arrangement, for example, may not only secure the recess body 710 in place but also further ensure a seal against ingress of concrete into the shoe body 361 through the access opening 364.

In some examples, a recess body can be seated on a front rim (or otherwise) along side walls of a shoe body. Thus, for example, the recess body can help to preserve clearance for accessing the access opening of the shoe body with a tool (e.g., preserving a large value for the range R1 as discussed relative to FIG. 9F). As illustrated in FIG. 10A, the recess body 710 is sized to also seat on the front rim along the top and bottom sides of the access opening 364. As shown with dashed lines in FIG. 10B, for instance, a height 732 of the recess body 710 can be shortened so that the recess body 710 seats on the rim 366 only along the side walls 358 of the shoe body 361 (or in otherwise shortened engagement relative to the unmodified height 732). Accordingly, the height 732 of the recess body 710 can be reduced by exclusion of a first material portion 734 above a reference line 736 and a second material portion 738 below a reference line 740. Such a configuration may reduce the overall size and weight of the recess body 710, while also reducing the amount of concrete material that is excluded from a relevant concrete section due to the inclusion of the recess body 710 (e.g., as can be later filled with additional pouring and curing operations).

In some examples, the one or more attachment features 720 of the recess body 710 may include discrete protrusions 750 that extend into the access opening to removably secure the recess body 710 to the shoe body 361. For instance, the recess body 710 may include a first protrusion 752 and a second protrusion 754 that extends away from the inner surface 728 of the recess body 710. In some examples, the protrusions 750 may include a hook or other shaped end to secure the recess body 710 to a shoe body.

Thus, for example, the boss 724 or the protrusions 750 (or other attachment features) can aid securing the recess body 710 to the shoe body 361 during formation of the concrete section 104. Relatedly, the hole 714 can be used to urge the recess body 710 away from the shoe body 361 to access the column shoe 350. For example, an operator may advance a pin or a rod 760 through the hole 714 to contact the shoe body 361 (e.g., advance a set screw that is recessed into the hole 714, to contact a front face of the shoe body 361). As noted above, in some cases the rod 760 can be configured as a relatively short set screw. In some examples, as illustrated in FIG. 10A, the holes 714 can be aligned with the rim 366 of the column shoe 350 above and below the access opening 364. In other examples, the holes 714 can be aligned so that a pin or rod engages the shoe body 361 at other locations on the front wall 360, or at an inner surface 772 of the internal cavity 362.

Figure 11B:
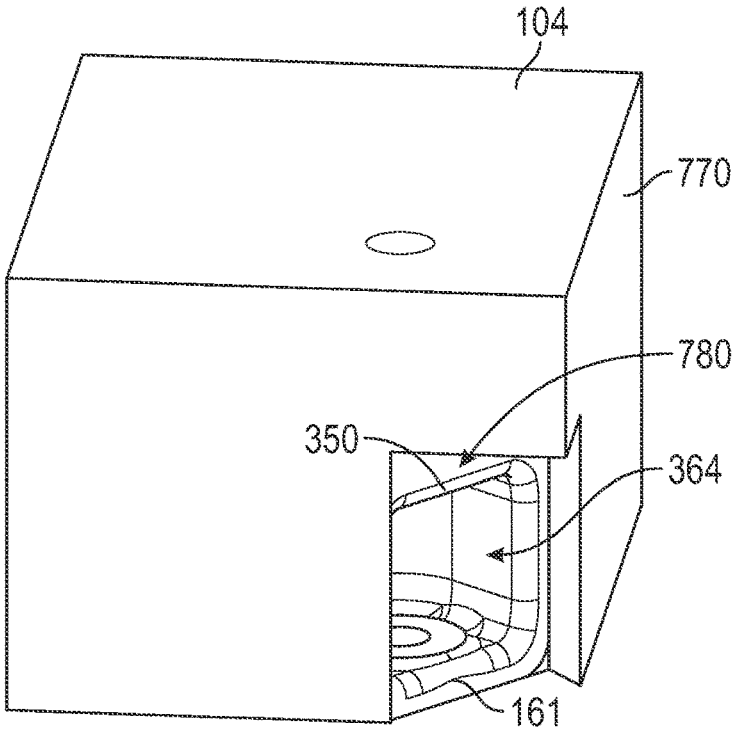

As shown in the succession from FIG. 11A to FIG. 11B, by advancing relevant pins, etc. (e.g., recessed set screws) through the holes 714, a user can push the recess body 710 away from the column shoe 350. Such an operation can accordingly free the recess body 710 from the surrounding concrete 770 to provide access to the front opening 364 of the column shoe 350 through the cavity in the concrete material left by the recess body 710. Correspondingly, the recess body 710 can thus be readily extracted for reuse (or disposal), as desired, and access to the column shoe 350 can be quickly and easily obtained. In some examples, threaded fasteners can be embedded within the holes 714 so that the end user can insert a tool (e.g., a powered or other driver) into the holes 714 to tighten the fasteners and thereby remove the recess box. In some examples, the fasteners can be captured in the holes 714, to improve ease of use and reduce the number of loose pieces required for assembly.

In some examples, the second concrete section 104 can be prefabricated with the recess body 710 removably covering the access opening 364 of the shoe body 361 (or the opening 264 of the shoe body 261, etc.). Correspondingly, to secure the first concrete section 102 and the second concrete section 104 using the threaded rebar 124, the recess body 710 may be removed from the second concrete section to expose the access opening 364 (or 264, etc.).

As also generally noted above, the column shoe assemblies 240, 340 illustrated in FIGS. 5 and 6 are alternative configurations of the column shoe assembly 140 of FIG. 2. Correspondingly, discussion of any of the column shoe assemblies 140, 240, 340 in a particular example above may be interchangeably applied to the others of the column shoe assemblies 140, 240, 340, with modification as appropriate corresponding to the discussed and illustrated differences between the assemblies presented above (e.g., differences in rim geometries, etc.).

In some implementations, devices or systems disclosed herein can be utilized, manufactured, installed, etc. using methods embodying aspects of the disclosed technology. Correspondingly, any description herein of particular features, capabilities, or intended purposes of a device or system should be considered to disclose, as examples of the disclosed technology a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated or limited, discussion herein of any method of manufacturing or using for a particular device or system, including installing the device or system, should be understood to disclose, as examples of the disclosed technology, the utilized features and implemented capabilities of such device or system.

In this regard, for example, some examples of the disclosed technology can include prefabricating concrete structures using the column shoe assemblies as disclosed herein (or components thereof), or securing concrete structures together using the column shoe assemblies disclosed herein (or components thereof). Similarly, some examples can include manufacturing or using sets of substantially identical column shoes or column shoe assemblies (e.g., of one or more sizes) for prefabrication or for on-site operations.

It is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

Also as used herein, unless otherwise limited or defined, "integral" and derivatives thereof (e.g., "integrally") describe elements that are manufactured as a single piece without fasteners, adhesive, or the like to secure separate components together. For example, an element stamped or cast as a single-piece component from a single piece of sheet metal or a single mold (etc.), without rivets, screws, or adhesive to hold separately formed pieces together, is an integral (and integrally formed) element. In contrast, an element formed from multiple pieces that are separately formed initially, then later connected together, is not an integral (or integrally formed) element.

Also as used herein, unless otherwise limited or specified, "substantially identical" refers to two or more components or systems that are manufactured or used according to the same process and specification, with variation between the components or systems that are within the limitations of acceptable tolerances for the relevant process and specification. For example, two components can be considered to be substantially identical if the components are manufactured according to the same standardized manufacturing steps, with the same materials, and within the same acceptable dimensional tolerances (e.g., as specified for a particular process or product).

Unless otherwise specified or limited, the terms "about" and "approximately", as used herein with respect to a reference value, refer to variations from the reference value of ±20% or less (e.g., ±15, ±10%, ±5%, etc.), inclusive of the endpoints of the range. Similarly, as used herein with respect to a reference value, the term "substantially equal" (and the like) refers to variations from the reference value of less than ±5% (e.g., ±2%, ±1%, ±0.5%) inclusive. Where specified in particular, "substantially" can indicate a variation in one numerical direction relative to a reference value. For example, the term "substantially less" than a reference value (and the like) indicates a value that is reduced from the reference value by 30% or more (e.g., 35%, 40%, 50%, 65%, 80%), and the term "substantially more" than a reference value (and the like) indicates a value that is increased from the reference value by 30% or more (e.g., 35%, 40%, 50%, 65%, 80%).

Additionally, unless otherwise specified or limited, "substantially coaxial" indicates that the described elements have axes that are substantially parallel with each other and are aligned so that extension of the axis one of the elements intersects an axial end of another of the elements (e.g., at or within a diameter thereof, within 50% of a diameter thereof, within 25% of a diameter thereof, or within 5%—or less—of a diameter thereof). Correspondingly, for example, substantially coaxial sections of rebar on opposing sides of a column shoe can extend substantially in parallel with each other, along a substantially identical axis, to provide single-direction load transmission across the column shoe as further detailed above.

Also as used herein, unless otherwise defined or limited, ordinal numbers are used for convenience of reference, based generally on the order in which particular components are presented in the relevant part of the disclosure. In this regard, for example, designations such as "first," "second," etc., generally indicate only the order in which a thus-labeled component is introduced for discussion and generally do not indicate or require a particular spatial, functional, temporal, or structural primacy or order.

The previous description of the disclosed examples is provided to enable any person skilled in the art to make or use the disclosed technology. Various modifications to these examples will be readily apparent to those skilled in the art, and the generic principles defined herein may be applied to other examples without departing from the spirit or scope of the disclosed technology. Thus, the disclosed technology is not intended to be limited to the examples shown herein but is to be accorded the widest scope consistent with the principles and novel features disclosed herein.

What is claimed is:

1. A column shoe assembly comprising:

a shoe body that defines:

an internal cavity that is closed continuously around a rear side and at opposite lateral sides by a rear wall and side walls of the shoe body;

a lower rod opening aligned to receive a first section of rod along a connection axis into the internal cavity;

an upper wall that secures a second section of rod opposite the lower rod opening;

an access opening that opens into the internal cavity at a front side of the shoe body, with a rim of the shoe body extending around the access opening, the rim, as measured along a cross section perpendicular to the connection axis, having a first material thickness that is larger, at a location between the connection axis and the access opening, than a second material thickness of the shoe body along the rear wall.

2. The column shoe assembly of claim 1, wherein the first material thickness is a largest material thickness of the rim as measured along the cross section perpendicular to the connection axis.

3. The column shoe assembly of claim 2, wherein the first material thickness is between 2 times and 8 times the second material thickness, inclusive.

4. The column shoe assembly of claim 3, wherein the first material thickness is between 3 times and 5 times the second material thickness, inclusive.

5. The column shoe assembly of claim 2, wherein the location of the first material thickness is rearward of a front face of the shoe body that surrounds the access opening.

6. The column shoe assembly of claim 5, wherein a front face of the rim extends rearwardly from the front face of the shoe body to the location of the first material thickness.

7. The column shoe assembly of claim 6, wherein the side walls of the shoe body taper continuously in thickness from the first material thickness to the second material thickness.

8. The column shoe assembly of claim 1, wherein the upper wall secures the second section of rod to be substantially coaxial with the connection axis.

9. The column shoe assembly of claim 1, wherein upper wall secures the second section of rod with a threaded connection.

10. The column shoe assembly of claim 1, further comprising:

a recess body arranged to removably cover the access opening, to prevent ingress of concrete into the shoe body via the access opening.

11. The column shoe assembly of claim 10, wherein the recess body supports a plurality of fasteners arranged to be advanced relative to the recess body to urge the recess body away from the shoe body.

12. The column shoe assembly of claim 11, wherein the fasteners are aligned to engage the rim of the shoe body.

13. The column shoe assembly of claim 10, wherein the recess body includes one or more protrusions that extend into the access opening to removably secure the recess body to the shoe body.

14. The column shoe assembly of claim 10, wherein the recess body is seated on the rim along at least the side walls of the shoe body.

15. A column shoe assembly comprising:

a column shoe, including a shoe body that is integrally formed and defines:

an internal cavity with a rear wall;

a lower rod opening that opens into the internal cavity and defines a connection axis;

a front access opening into the internal cavity on an opposite side of the connection axis from the rear wall; and a thickened rim extending along a perimeter of the front access opening;

a first section of rod extending through the lower rod opening along the connection axis, the first section of rod being threadedly secured within the internal cavity with a threaded fastener that is fully within the internal cavity and accessible via the front access opening for threaded adjustment along the first section of rod; and a second section of rod secured to an upper side of the shoe body to extend away from the column shoe opposite the lower rod opening.

16. The column shoe assembly of claim 15, further comprising:

a recess body that removably covers the front access opening and seats on the thickened rim at least along opposing sides of the front access opening, to seal against ingress of concrete into the shoe body through the front access opening.

17. A method of connecting concrete sections, the method comprising:

providing a first concrete section with a first threaded rod protruding from an end of the first concrete section;

providing a second concrete section with a column shoe assembly embedded therein, the column shoe assembly including:

a column shoe with a shoe body that includes an internal cavity with a rear wall, a lower opening that opens into the internal cavity, a front access opening into the internal cavity on an opposite side of a connection axis from the rear wall, and a thickened rim extending along a perimeter of the front access opening; and a second rod secured to an upper side of the shoe body, opposite the lower opening, and extending from the column shoe within the second concrete section;

aligning the first and second concrete sections to insert the first threaded rod through the lower opening, along the connection axis, into the internal cavity of the column shoe; and threadedly securing the first threaded rod within the internal cavity by accessing the first threaded rod within the internal cavity via the front access opening.

18. The method of claim 17, wherein providing the first and second concrete sections includes prefabricating one or more of the first concrete section or the second concrete section at a first location and transporting the one or more prefabricated first or second concrete sections to a second location to be aligned for insertion of the first threaded rod through the lower opening.

19. The method of claim 18, wherein the method includes prefabricating the second concrete section with the second rod threadedly secured to the shoe body.

20. The method of claim 18, wherein the method includes:

prefabricating the second concrete section with a recess body that removably covers the front access opening; and before threadedly securing the first threaded rod within the internal cavity, removing the recess body from the second concrete section to expose the front access opening.

* * * * *